US010753367B2

(12) United States Patent
Uneura et al.

(10) Patent No.: US 10,753,367 B2
(45) Date of Patent: Aug. 25, 2020

(54) MOUNTING STRUCTURE AND TURBOCHARGER

(71) Applicant: IHI Corporation, Koto-ku (JP)

(72) Inventors: Yutaka Uneura, Tokyo (JP); Kenji Bunno, Tokyo (JP); Yuichi Daito, Tokyo (JP); Shinichi Kaneda, Tokyo (JP); Kenichi Segawa, Tokyo (JP); Atsushi Tezuka, Tokyo (JP)

(73) Assignee: IHI Corporation, Koto-ku (JP)

( * ) Notice: Subject to any disclaimer, the term of this patent is extended or adjusted under 35 U.S.C. 154(b) by 82 days.

(21) Appl. No.: 15/988,793

(22) Filed: May 24, 2018

(65) Prior Publication Data

US 2018/0266432 A1 Sep. 20, 2018

Related U.S. Application Data

(63) Continuation of application No. PCT/JP2016/084474, filed on Nov. 21, 2016.

(30) Foreign Application Priority Data

Dec. 1, 2015 (JP) ..... 2015-234689

(51) Int. Cl.
*F04D 29/26* (2006.01)
*F01D 5/02* (2006.01)
(Continued)

(52) U.S. Cl.
CPC ..... *F04D 29/266* (2013.01); *F01D 5/025* (2013.01); *F02B 39/00* (2013.01); *F04D 29/00* (2013.01);
(Continued)

(58) Field of Classification Search
CPC ..... F04D 29/00; F04D 29/053; F04D 29/226; F05D 2220/40; F05D 2230/64; F05D 2260/30; F05D 2240/60
(Continued)

(56) References Cited

U.S. PATENT DOCUMENTS 4,519,747 A * 5/1985 Yamazaki ..... F01D 5/025 416/244 A
4,884,942 A * 12/1989 Pennink ..... F16C 32/0692 415/104
(Continued)

FOREIGN PATENT DOCUMENTS

CN 101187315 A 5/2008
CN 102639841 8/2012
(Continued)

OTHER PUBLICATIONS

International Preliminary Report on Patentability and Written Opinion dated Jun. 14, 2018 in PCT/JP2016/084474 (English Translation only), 13 pages.
(Continued)

*Primary Examiner* — Kenneth J Hansen
*Assistant Examiner* — Andrew J Marien
(74) *Attorney, Agent, or Firm* — Oblon, McClelland, Maier & Neustadt, L.L.P.

(57) ABSTRACT

Provided is a mounting structure, including: an impeller including: a main body portion having a through hole; a plurality of blades provided to an outer peripheral surface of the main body portion; and a boss portion, which is a part of the main body portion, and protrudes toward one end side of the shaft with respect to the plurality of blades; a small-diameter portion, which is a part of the shaft; a first large-diameter portion, which is a part of the shaft, is located on another end side of the shaft with respect to the small-
(Continued)

diameter portion; and a small-inner-diameter portion of the through hole, which is formed on a radially inner side of the boss portion, and has an inner diameter smaller than an inner diameter of a part of the through hole which is opposed to the first large-diameter portion in a radial direction.

17 Claims, 4 Drawing Sheets

(51) Int. Cl.
*F02B 39/00* (2006.01)
*F04D 29/053* (2006.01)
*F04D 29/00* (2006.01)

(52) U.S. Cl.
CPC ..... *F04D 29/053* (2013.01); *F05D 2220/40* (2013.01); *F05D 2230/64* (2013.01); *F05D 2240/20* (2013.01); *F05D 2240/60* (2013.01); *F05D 2260/30* (2013.01)

(58) Field of Classification Search
USPC ..... 416/174; 415/104, 206, 216.1
See application file for complete search history.

(56) References Cited

U.S. PATENT DOCUMENTS

| | | | | |
|---|---|---|---|---|
| 6,364,634 | B1 * | 4/2002 | Svihla | F01D 5/025 417/409 |
| 6,368,077 | B1 * | 4/2002 | Meyerkord | F01D 11/02 277/320 |
| 6,478,553 | B1 * | 11/2002 | Panos | F01D 25/16 310/90 |
| 6,896,479 | B2 * | 5/2005 | Svihla | F01D 5/026 415/104 |
| 9,598,961 | B2 * | 3/2017 | Gurao | F01D 5/066 |
| 10,233,936 | B2 * | 3/2019 | Daguin | F04D 17/10 |
| 10,578,116 | B2 | 3/2020 | Hayashi et al. | |
| 2010/0139270 | A1 * | 6/2010 | Koch | F01D 25/16 60/605.3 |
| 2012/0219245 | A1 * | 8/2012 | McKeiman, Jr. | F16C 19/163 384/473 |
| 2013/0004300 | A1 * | 1/2013 | Scholz | F01D 5/025 415/170.1 |
| 2013/0115088 | A1 * | 5/2013 | Castan | F04D 29/054 416/204 A |
| 2015/0369081 | A1 * | 12/2015 | Takabatake | F02B 39/14 415/111 |
| 2016/0177956 | A1 * | 6/2016 | Mohtar | F01D 17/146 417/406 |
| 2016/0273545 | A1 | 9/2016 | Hayashi et al. | |
| 2016/0319832 | A1 * | 11/2016 | Takahara | F04D 29/266 |

FOREIGN PATENT DOCUMENTS

| | | | |
|---|---|---|---|
| CN | 103089397 | A | 5/2013 |
| CN | 105683502 | A | 6/2016 |
| DE | 1 933 684 | A | 1/1970 |
| DE | 10 2009 060 056 | A1 | 6/2011 |
| DE | 10 2014 213 641 | A | 8/2015 |
| EP | 2 592 280 | A2 | 5/2013 |
| EP | 3 081 746 | A1 | 10/2016 |
| JP | 52-137702 | A | 11/1977 |
| JP | 58-74830 | A | 5/1983 |
| JP | 1-159131 | U | 11/1989 |
| JP | 2002-242937 | | 8/2002 |
| JP | 2006-9634 | | 1/2006 |
| JP | 2010-43599 | | 2/2010 |
| JP | 2011-122536 | | 6/2011 |
| JP | 2013-515208 | | 5/2013 |
| JP | 2015-108378 | | 6/2015 |
| KR | 10-2012-0103688 | | 9/2012 |
| KR | 10-2016-0057476 | | 5/2016 |
| WO | WO 2015/087414 | A1 | 6/2015 |
| WO | WO 2015/146765 | A1 | 10/2015 |

OTHER PUBLICATIONS

International Search Report dated Feb. 7, 2017 in PCT/JP2016/084474, filed on Nov. 21, 2016 (with English Translation).
Combined Chinese Office Action and Search Report dated Sep. 30, 2019 in Chinese Patent Application No. 201680067972.X (with partial unedited computer generated English translation and English translation of Categories of Cited Documents), 15 pages.
German Office Action issued in German Patent Application No. 112016005491.2 dated May 25, 2020 (w/ English Translation).

* cited by examiner

MOUNTING STRUCTURE AND TURBOCHARGER

CROSS REFERENCE TO RELATED APPLICATIONS

This application is a continuation application of International Application No. PCT/JP2016/084474, filed on Nov. 21, 2016, which claims priority to Japanese Patent Application No. 2015-234689, filed on Dec. 1, 2015, the entire contents of which are incorporated by reference herein.

BACKGROUND ART

Technical Field

The present disclosure relates to a mounting structure for mounting an impeller to a shaft, and a turbocharger.

Related Art

Hitherto, there has been known a turbocharger in which a shaft is axially supported so as to be rotatable in a bearing housing. A turbine impeller is provided at one end of the shaft, and a compressor impeller is provided at another end of the shaft. The turbocharger is connected to an engine. The turbine impeller is rotated by exhaust gas discharged from the engine. The rotation of the turbine impeller causes the compressor impeller to rotate through the shaft. The turbocharger compresses air along with the rotation of the compressor impeller and delivers the compressed air to the engine.

The compressor impeller includes a main body portion and a plurality of blades. The plurality of blades are provided to an outer circumference surface of the main body portion. The main body portion of the compressor impeller has a through hole. The shaft is inserted to the through hole. In a configuration described in Patent Literature 1, at a part of the shaft which is inserted to the through hole, two large-diameter portions are formed with a small-diameter portion formed therebetween. The shaft is centered by the two large-diameter portions so as to be coaxial with the through hole.

CITATION LIST

Patent Literature

Patent Literature 1: Japanese Patent Application Laid-Open No. 2015-108378

SUMMARY

Technical Problem

For example, in the configuration of the compressor impeller described in Patent Literature 1, when the shaft and the impeller rotate together, the plurality of blades cause a centrifugal force to act on the main body portion to widen the through hole. As a result, the large-diameter portions separate from an inner circumference surface of the through hole. Thus, there is a fear in that eccentricity of the impeller with respect to the shaft increases, which results in increase in unbalance.

An object of the present disclosure is to provide a mounting structure and a turbocharger, which are capable of suppressing the increase in unbalance.

Solution to Problem

In order to solve the above-mentioned problem, according to one mode of the present disclosure, there is provided: a mounting structure, including: an impeller including: a main body portion having a through hole to which a shaft is inserted; a plurality of blades provided to an outer circumference surface of the main body portion; and a boss portion, which is a part of the main body portion, and protrudes toward one end side of the shaft with respect to the plurality of blades; a small-diameter portion, which is a part of the shaft, and is opposed to an inner circumference surface of the through hole and spaced apart in the radial direction of the shaft; a first large-diameter portion, which is a part of the shaft, is located on another end side of the shaft with respect to the small-diameter portion, and has an outer diameter larger than an outer diameter of the small-diameter portion; and one or both of a second large-diameter portion of the shaft and a small-inner-diameter portion of the through hole, the second large-diameter portion being located on one end side of the shaft with respect to the small-diameter portion, having an outer diameter larger than an outer diameter of the small-diameter portion, and being located on a radially inner side of the boss portion, the small-inner-diameter portion being formed on a radially inner side of the boss portion, and having an inner diameter smaller than an inner diameter of a part of the through hole which is opposed to the first large-diameter portion in a radial direction.

The second large-diameter portion may extend longer in the axial direction of the shaft than the first large-diameter portion.

The through hole and the first large-diameter portion may be fitted to each other by interference fitting, and the through hole and the second large-diameter portion may be fitted to each other by intermediate fitting.

There may be further included a third large-diameter portion of the shaft, which is located between the first large-diameter portion and the second large-diameter portion, and has an outer diameter larger than an outer diameter of the small-diameter portion.

A back surface portion of the main body portion, which is located on another end side of the shaft with respect to the plurality of blades, may be inclined in such an orientation that an outer diameter thereof decreases toward the another end side of the shaft, and the first large-diameter portion may be located on a radially inner side of the back surface portion.

The small-diameter portion may be located on a radially inner side of the radially outermost portion of the main body portion which extends to an outermost side in the radial direction of the shaft.

In order to solve the above-mentioned problem, according to one mode of the present disclosure, there is provided a turbocharger, including the above-mentioned mounting structure.

Effects of Disclosure

According to the present disclosure, it is possible to suppress the increase in unbalance.

DESCRIPTION OF EMBODIMENT

Figure 1:
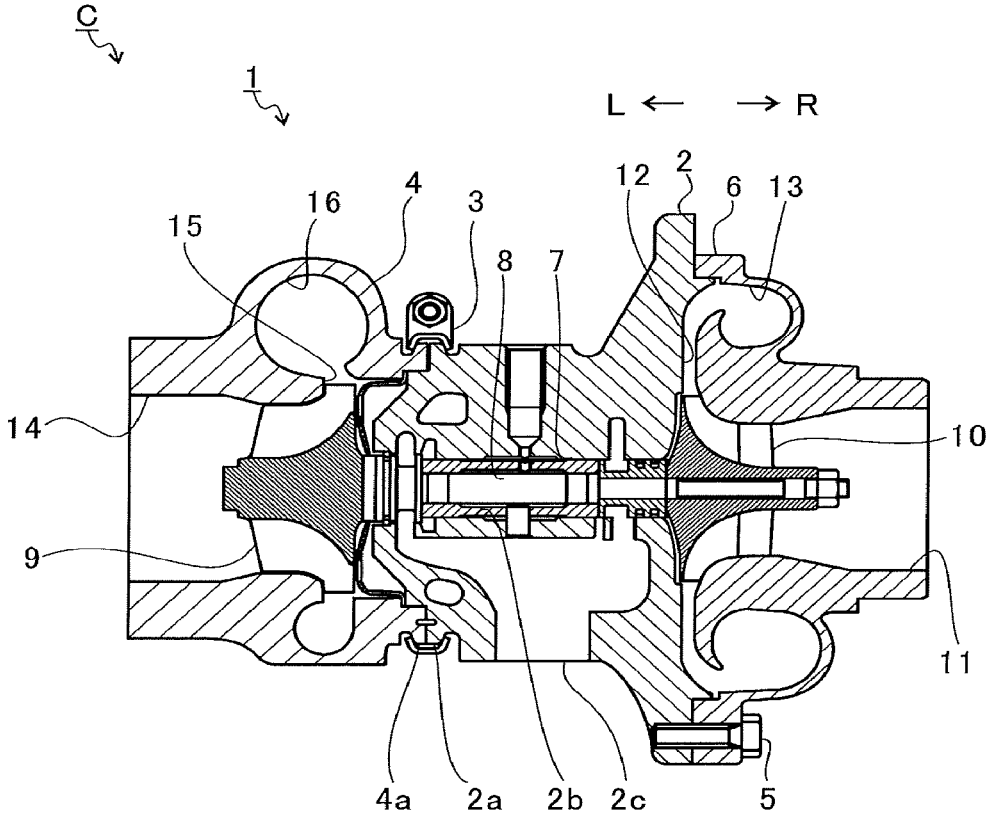
FIG. 1 is a schematic sectional view for illustrating a turbocharger.

Now, with reference to the attached drawings, an embodiment of the present disclosure is described in detail. The dimensions, materials, and other specific numerical values represented in the embodiment are merely examples used for facilitating the understanding, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view for illustrating a turbocharger C. In the following description, the direction indicated by the arrow L illustrated in FIG. 1 corresponds to a left side of the turbocharger C, and the direction indicated by the arrow R illustrated in FIG. 1 corresponds to a right side of the turbocharger C. As illustrated in FIG. 1, the turbocharger C includes a turbocharger main body 1. The turbocharger main body 1 includes a bearing housing 2 (housing). A turbine housing 4 is coupled to the left side of the bearing housing 2 by a fastening mechanism 3. A compressor housing 6 is coupled to the right side of the bearing housing 2 by a fastening bolt 5. The bearing housing 2, the turbine housing 4, and the compressor housing 6 are integrally formed.

On an outer circumference surface of the bearing housing 2 in the vicinity of the turbine housing 4, there is formed a projection 2*a*. The projection 2*a* projects in a radial direction of the bearing housing 2. Further, on an outer circumference surface of the turbine housing 4 in the vicinity of the bearing housing 2, there is formed a projection 4*a*. The projection 4*a* projects in a radial direction of the turbine housing 4. The bearing housing 2 and the turbine housing 4 are fixed to each other by band-fastening the projections 2*a* and 4*a* with the fastening mechanism 3. The fastening mechanism 3 is constructed by, for example, a G-coupling for clamping the projections 2*a* and 4*a*.

The bearing housing 2 has a bearing hole 2*b*. The bearing hole 2*b* penetrates in a right-and-left direction of the turbocharger C. A shaft 8 is axially supported so as to be rotatable by a bearing 7 (which in FIG. 1, there is illustrated a semi-floating bearing as an example), which is provided to the bearing hole 2*b*. A turbine impeller 9 is provided to a left end portion of the shaft 8. The turbine impeller 9 is received in the turbine housing 4 so as to be rotatable. Further, a compressor impeller 10 (impeller) is provided to a right end portion of the shaft 8. The compressor impeller 10 is received in the compressor housing 6 so as to be rotatable.

The compressor housing 6 has a intake port 11. The intake port 11 is opened on the right side of the turbocharger C. The intake port 11 is connected to an air cleaner (not shown). Further, as described above, under a state in which the bearing housing 2 and the compressor housing 6 are coupled to each other by the fastening bolt 5, a diffuser flow passage 12 is formed. The diffuser flow passage 12 is formed of opposed surfaces of the bearing housing 2 and the compressor housing 6. In the diffuser flow passage 12, the air is increased in pressure. The diffuser flow passage 12 has an annular shape. The diffuser flow passage 12 communicates with the intake port 11 on the above-mentioned radially inner side through intermediation of the compressor impeller 10.

Further, the compressor housing 6 has a compressor scroll flow passage 13. The compressor scroll flow passage 13 has an annular shape. The compressor scroll flow passage 13 is positioned on the radially outer side of the shaft 8 with respect to the diffuser flow passage 12. The compressor scroll flow passage 13 communicates with a intake port of an engine (not shown). The compressor scroll flow passage 13 communicates also with the diffuser flow passage 12. Thus, when the compressor impeller 10 is rotated, air is sucked into the compressor housing 6 through the intake port 11. The sucked air is increased in speed by a centrifugal force during a course of flowing through blades of the compressor impeller 10. The air having been increased in speed and pressure is further increased in pressure in the diffuser flow passage 12 and the compressor scroll flow passage 13. The air increased in pressure is introduced to the intake port of the engine.

The turbine housing 4 has a discharge port 14. The discharge port 14 is opened on the left side of the turbocharger C. The discharge port 14 is connected to an exhaust gas purification device (not shown). Further, a flow passage 15 and a turbine scroll flow passage 16 are formed in the turbine housing 4. The turbine scroll flow passage 16 has an annular shape. The turbine scroll flow passage 16 is positioned on the radially outer side of the turbine impeller 9 with respect to the flow passage 15. The turbine scroll flow passage 16 communicates with a gas inflow port (not shown). The exhaust gas discharged from an exhaust gas manifold of the engine (not shown) is introduced to the gas inflow port. The turbine scroll flow passage 16 communicates also with the flow passage 15. Thus, the exhaust gas introduced through the gas inflow port to the turbine scroll flow passage 16 is introduced to the discharge port 14 through the flow passage 15 and the turbine impeller 9. The exhaust gas to be introduced to the discharge port 14 causes the turbine impeller 9 to rotate during a course of flowing.

Then, a rotational force of the turbine impeller 9 is transmitted to the compressor impeller 10 through the shaft 8. The rotational force of the compressor impeller 10 causes the air to be increased in pressure and introduced to the intake port of the engine as described above.

Figure 2A:
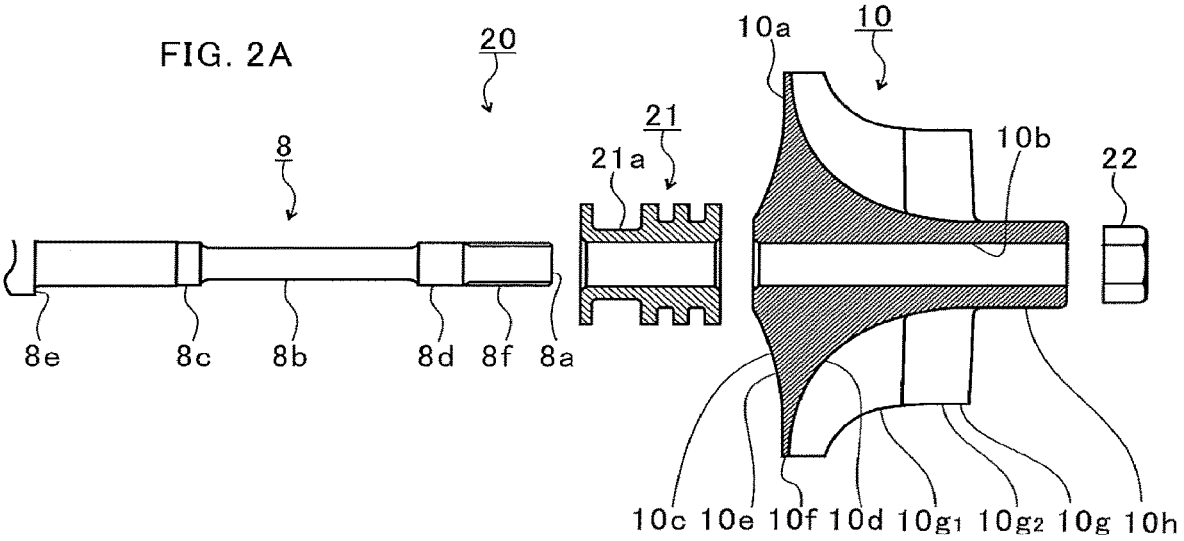
FIG. 2A is an illustration of a state before a compressor impeller is mounted to a shaft.
Figure 2B:
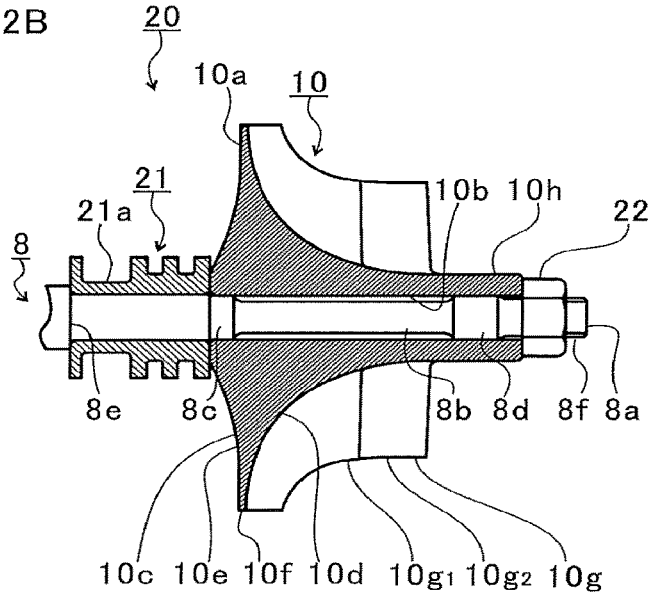
FIG. 2B is an illustration of a state after the compressor impeller is mounted to the shaft.

FIG. 2A is an illustration of a state before the compressor impeller 10 is mounted to the shaft 8. FIG. 2B is an illustration of a state after the compressor impeller 10 is mounted to the shaft 8. As illustrated in FIG. 2A and FIG. 2B, a mounting structure 20 includes an oil thrower member 21 and a nut 22 in addition to the shaft 8 and the compressor impeller 10.

The oil thrower member 21 includes a main body portion 21*a*. The main body portion 21*a* has a cylindrical shape. One end 8*a* of the shaft 8 is inserted to the main body portion 21*a*. Part of lubricating oil having lubricated the bearing 7 illustrated in FIG. 1 flows along the shaft 8 to the one end 8*a* side of the shaft 8. The lubricating oil having flowed to the one end 8*a* side of the shaft 8 reaches the main body portion 21*a* of the oil thrower member 21 on a closer side with respect to the compressor impeller 10. The oil thrower member 21 causes the lubricating oil to be diffused to the radially outer side by the centrifugal force. The diffused lubricating oil is discharged to an outside through an oil discharge port 2*c* (see FIG. 1) formed in the bearing housing 2. As described above, the oil thrower member 21 has a function of suppressing leakage of the lubricating oil to the compressor impeller 10 side.

Further, the compressor impeller 10 includes a main body portion 10*a*. The main body portion 10*a* has an annular shape. The main body portion 10*a* has a through hole 10*b*. The shaft 8 is inserted to the through hole 10*b*. As illustrated in FIG. 2B, a front surface portion 10*d* is formed in an outer circumference surface 10*c* of the main body portion 10*a*. The front surface portion 10*d* is inclined in such an orientation that an outer diameter thereof decreases toward one end 8*a* side of the shaft 8. A back surface portion 10*e* is formed on a side opposite to the front surface portion 10*d* in the outer circumference surface 10*c* of the main body portion 10*a*. The back surface portion 10*e* is inclined, for example, in such an orientation that an outer diameter thereof decreases toward another end side (left side in FIGS. 2A and 2B) of the shaft 8. The back surface portion 10*e* may extend, for example, so as to be perpendicular to an axial direction of the shaft 8. A radially outermost portion 10*f* is formed between the front surface portion 10*d* and the back surface portion 10*e*. The radially outermost portion 10*f* extends in the axial direction of the shaft 8. The radially outermost portion 10*f* extends from the front surface portion 10*d* to the back surface portion 10*e*. The radially outermost portion 10*f* extends to the most outer side of the main body portion 10*a* in the radial direction of the shaft 8.

A plurality of blades 10*g* are provided to the front surface portion 10*d* of the main body portion 10*a*. The plurality of blades 10*g* extend from an end portion of the front surface portion 10*d* on the radially outermost portion 10*f* side toward the one end 8*a* side of the shaft 8. The plurality of blades 10*g* are arranged apart from each other in a circumferential direction of the front surface portion 10*d*. The plurality of blades 10*g* include a plurality of short blades $\mathbf{10}g_1$ and a plurality of long blades $\mathbf{10}g_2$. The plurality of long blades $\mathbf{10}g_2$ extend longer than the short blades $\mathbf{10}g_1$ toward the one end 8*a* side in the axial direction of the shaft 8. In the following description, when the plurality of blades 10*g* are referred, both the plurality of short blades $\mathbf{10}g_2$ and the plurality of long blades $\mathbf{10}g_2$ are included.

The boss portion 10*h* is a part of the main body portion 10*a* which protrudes toward the one end 8*a* side of the shaft 8 (than either the short blades 10*g*, or the long blades $\mathbf{10}g_2$) than the plurality of blades 10*g*. That is, the plurality of blades 10*g* are not arranged on the radially outer side of the boss portion 10*h*.

Further, the shaft 8 has a small-diameter portion 8*b*, a first large-diameter portion 8*c*, a second large-diameter portion 8*d*, and a step surface 8*e*. The first large-diameter portion 8*c* is formed on another end side of the shaft 8 with respect to the small-diameter portion 8*b* in the shaft 8. The second large-diameter portion 8*d* is formed on the one end 8*a* side of the shaft 8 with respect to the small-diameter portion 8*b* in the shaft 8.

That is, the small-diameter portion 8*b* is formed between the first large-diameter portion 8*c* and the second large-diameter portion 8*d*. The first large-diameter portion 8*c* and the second large-diameter portion 8*d* have an outer diameter larger than that of the small-diameter portion 8*b*. The second large-diameter portion 8*d* extends longer in the axial direction of the shaft 8 than the first large-diameter portion 8*c*.

A step surface 8*e* is formed on another end side of the shaft 8 with respect to the first large-diameter portion 8*c*. The step surface 8*e* is formed by a diameter difference of the shaft 8. The step surface 8*e* extends in a radial direction of the shaft 8. The step surface 8*e* faces one end 8*a* side of the shaft 8.

Next, a procedure of mounting the compressor impeller 10 to the shaft 8 is described. First, from the state illustrated in FIG. 2A, the shaft 8 is inserted to the main body portion 21*a* until a left end portion on the left side in FIG. 2A in the main body portion 21*a* of the oil thrower member 21 reaches a position of being held in abutment against the step surface 8*e*.

The shaft 8 is inserted to the through hole 10*b* of the main body portion 10*a* until a right end portion of the main body portion 21*a* of the oil thrower member 21 on a side opposite to the left end portion of the main body portion 21*a* reaches a position of being held in abutment against a left end portion of the main body portion 10*a* of the compressor impeller 10 on the left side in FIG. 2A.

A thread portion 8*f* is formed on the one end 8*a* side of the shaft 8. The thread portion 8*f* has a thread groove. Under a state in which the shaft 8 is inserted to the main body portion 21*a* and the main body portion 10*a*, the thread portion 8*f* projects from the main body portion 10*a*. The nut 22 is screwed to the projection part of the thread portion 8*f*. Through fastening of the nut 22 to the thread portion 8*f*, an axial force is generated between the step surface 8*e* of the shaft 8 and the nut 22. With the axial force, as illustrated in FIG. 2B, the oil thrower member 21 and the compressor impeller 10 are mounted to the shaft 8.

At this time, the small-diameter portion 8*b* is opposed to the inner circumference surface of the through hole 10*b* of the main body portion 10*a* and spaced apart in the radial direction of the shaft 8. That is, a clearance is formed in the radial direction of the shaft 8 between the small-diameter portion 8*b* and the inner circumference surface of the through hole 10*b*.

The through hole 10*b* and the first large-diameter portion 8*c* have a dimensional relationship of providing interference fitting to each other. The through hole 10*b* and the second large-diameter portion 8*d* have a dimensional relationship of providing intermediate fitting to each other.

Specifically, an outer diameter of the first large-diameter portion 8*c* is larger than an inner diameter of the through hole 10*b*. The first large-diameter portion 8*c* is thermally fitted (fitted by shrinkage fitting) to the through hole 10*b*, for example, by heating the compressor impeller 10.

Further, an upper limit value of a dimensional tolerance in outer diameter of the second large-diameter portion 8*d* is larger than a lower limit value of a dimensional tolerance in inner diameter of the through hole 10*b*. A lower limit value of the dimensional tolerance in outer diameter of the second large-diameter portion 8*d* is smaller than an upper limit value of the dimensional tolerance in inner diameter of the through hole 10*b*. That is, the second large-diameter portion 8*d* and the inner circumference surface of the through hole 10*b* may form an interference or a gap within a range of the dimensional tolerance. The outer diameter of the second large-diameter portion 8*d* may be larger than, equal to, or smaller than the inner diameter of the through hole 10*b*.

Herein, an inner diameter of the through hole 10*b* in a region from a part opposed to the first large-diameter portion 8*c* in the radial direction to a part opposed to the second large-diameter portion 8*d* in the radial direction is substantially the same. The interference fitting is provided on the first large-diameter portion 8*c* side, and the intermediate fitting is provided on the second large-diameter portion 8*d* side. Generally, a diameter of the first large-diameter portion 8*c* is slightly larger than a diameter of the second large-diameter portion 8*d* in many cases. Therefore, through arrangement of the second large-diameter portion 8*d* on the one end 8*a* side of the shaft 8, the shaft 8 can easily be inserted to the through hole 10*b* from the one end 8*a* side. Thus, ease of assembly is improved.

Herein, a small-diameter portion 8*b* which is smaller in diameter and more liable to be elastically deformed than the first large-diameter portion 8*c* and the second large-diameter portion 8*d* is formed. The shaft 8 is stretched by fastening with the nut 22. As a result, a stable axial force is generated.

Further, as mentioned above, the shaft 8 has two large-diameter portions (first large-diameter portion 8*c* and second large-diameter portion 8*d*). Therefore, the large-diameter portions are guided by the inner circumference surface of the through hole 10*b*. While a positional relationship in which the compressor impeller 10 is set coaxial with the shaft 8 is maintained, the shaft 8 is inserted to the compressor impeller 10. Further, the two large-diameter portions are spaced apart from each other on both ends of the small-diameter portion 8*b*. As compared to the case in which the two large-diameter portions are adjacent to each other, inclination of the compressor impeller 10 with respect to an axial center of the shaft 8 is effectively suppressed during assembly.

When the compressor impeller 10 rotates at high speed, the through hole 10*b* of the compressor impeller 10 is widened by a centrifugal force. As a result, the large-diameter portions are spaced apart from the inner circumference surface of the through hole 10*b*. A clearance is formed between the inner circumference surface of the through hole 10*b* and the shaft 8. There is a possibility that the compressor impeller 10 becomes more eccentric with respect to the axial center of the shaft 8 by the amount of the clearance. As a result, depending on a phase in a rotation direction of unbalance of the compressor impeller 10 alone, there is a fear of causing increase in unbalance of the rotary member. The rotary member is constructed, for example, by integrally mounting the turbine impeller 9, the oil thrower 21, and the compressor impeller 10 to the shaft 8.

Therefore, in this embodiment, the second large-diameter portion 8*d* is arranged on a radially inner side of the boss portion 10*h*. The plurality of blades 10*g* are not provided on the radially outer side of the boss portion 10*h*. The boss portion 10*h* is less liable to be affected by the centrifugal force of the blades 10*g* during rotation. Therefore, in a region of the through hole 10*b* on the radially inner side of the boss portion 10*h*, the inner circumference surface is not widened so much. The amount of eccentricity of the compressor impeller 10 with respect to the axial center of the shaft 8 is suppressed. The increase in unbalance of the rotary member is suppressed.

Further, the first large-diameter portion 8*c* is arranged on a radially inner side of the back surface portion 10*e* in the main body portion 10*a* of the compressor impeller 10. A part of the through hole 10*b* which is positioned on the radially inner side of the radially outermost portion 10*f* has a large mass of extension toward the radially inner side of the radially outermost portion 10*f*. A part of the through hole 10*b* which is located on the radially inner side of the radially outermost portion 10*f* is liable to be widened by a large centrifugal force applied thereto. The back surface portion 10*e* is formed so as to incline in a direction in which an outer diameter decreases from the radially outermost portion 10*f* toward another end side of the shaft 8. The back surface portion 10*e* has a smaller mass of extension toward the radially outer side as compared to the radially outermost portion 10*f*. That is, in a region of the through hole 10*b* which is located on the radially inner side of the back surface portion 10*e*, the increase in diameter of the inner circumference surface is alleviated. Therefore, the amount of eccentricity of the compressor impeller 10 with respect to the axial center of the shaft 8 is suppressed. The increase in unbalance of the rotary member is suppressed.

Further, the first large-diameter portion 8*c* is fitted to the through hole 10*b* by interference fitting. The compressor impeller 10 is mounted to the shaft 8 by a friction force. Before the first large-diameter portion 8*c* is fitted by interference fitting, an outer diameter of the first large-diameter portion 8*c* is larger than an inner diameter of the through hole 10*b*. Even when the through hole 10*b* is widened by the centrifugal force, the first large-diameter portion 8*c* is increased in diameter to be in conformity with the through hole 10*b* by the amount of interference. Separation of the first large-diameter portion 8*c* apart from the inner circumference surface of the through hole 10*b* is suppressed. Therefore, even when a large centrifugal force is applied to the compressor impeller 10 by high-speed rotation, formation of a gap due to the separation of the first large-diameter portion 8*c* and the inner circumference surface of the through hole 10*b* is suppressed. The amount of eccentricity of the compressor impeller 10 with respect to the axial center of the shaft 8 is suppressed. Increase in unbalance of the rotary member is suppressed until the reach of a high-speed rotation region.

Further, the second large-diameter portion 8*d* extends longer in the axial direction of the shaft 8 than the first large-diameter portion 8*c*. Even when a dimensional relationship provides intermediate fitting with the through hole 10*b*, the second large-diameter portion 8*d* is likely to be guided by the inner circumference surface of the through hole 10*b*. Further, the positional relationship in which the compressor impeller 10 is coaxial with the shaft 8 is stably maintained during assembly.

Further, the first large-diameter portion 8*c* has such a length in the axial direction that the first large-diameter portion 8*c* does not reach a part which is located on the radially inner side of the radially outermost portion 10*f* from the back surface portion 10*e*. Not limited to this configuration, the length of the first large-diameter portion 8*c* in the axial direction may suitably be set in consideration of, for example, ease of assembly of the compressor impeller 10 to the shaft 8 and an effect of suppressing unbalance of the rotary member. For example, the first large-diameter portion 8*c* may extend to the one end 8*a* side of the shaft 8 in the axial direction while including a region located on the radially inner side of the radially outermost portion 10*f*. Further, the first large-diameter portion 8*c* may be formed in the axial direction with a starting point located at a position separated apart from the back surface portion 10*e* toward the one end 8*a* side of the shaft 8 in the axial direction. That is, through formation of the first large-diameter portion 8*c* so as to include at least a part of the region located on the radially inner side of the back surface portion 10*e*, the two large-diameter portions are arranged sufficiently apart from each other. Therefore, during assembly or rotation of the shaft 8, the inclination of the compressor impeller 10 with respect to the axial center of the shaft 8 is more effectively suppressed.

Further, the small-diameter portion 8*b* is located on the radially inner side of the radially outermost portion 10*f*. A part of the through hole 10*b* which is located on a radially inner side of the radially outermost portion 10*f* is liable to be increased in diameter by a large centrifugal force applied thereto. In this embodiment, the small-diameter portion 8*b* is located on the radially inner side of the radially outermost portion 10*f*. On the radially inner side of the radially outermost portion 10*f*, a mutual fitting structure is not provided. That is, the first large-diameter portion 8*c* and the second large-diameter portion 8*d* are arranged so as to avoid the radially inner side of the radially outermost portion 10*f*. In this case, a part of the inner circumference surface of the through hole 10*b* which is opposed to the first large-diameter portion 8*c* and the second large-diameter portion 8*d* in the radial direction is less liable to be increased in diameter. The increase in unbalance is suppressed.

Figure 3:
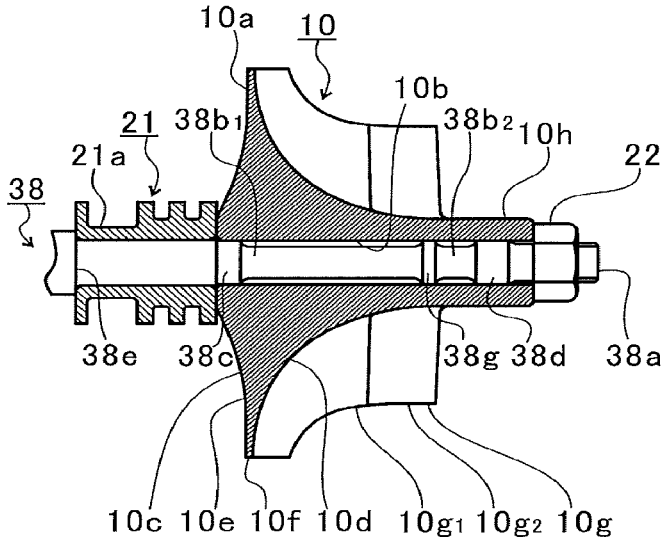
FIG. 3 is an explanatory view for illustrating a first modification example.

FIG. 3 is an explanatory view for illustrating a first modification example. In the above-mentioned embodiment, description is made of the case in which the two large-diameter portions are formed in the shaft 8. In the first modification example, three large-diameter portions are formed in a shaft 38.

For example, a third large-diameter portion 38*g* is formed between the first large-diameter portion 38*c* and the second large-diameter portion 38*d* in the shaft 38. The third large-diameter portion 38*g* may be formed on one end 38*a* side of a shaft 38 on the radially inner side of the plurality of blades 10*g*. The number of the large-diameter portions is not limited to three. The number of the large-diameter portions may suitably be set in accordance with, for example, a length of the compressor impeller 10 in the axial direction. For example, the number of the large-diameter portions may be four. A position of the large-diameter portion formed between the first large-diameter portion 38*c* and the second large-diameter portion 38*d* is not limited to the one end 38*a* side of the shaft 38. The large-diameter portion may suitably be formed at any position between the first large-diameter portion 38*c* and the second large-diameter portion 38*d*. For example, the large-diameter portion may be formed on another end side of the shaft 38. However, when the large-diameter portion is formed on the one end 38*a* side of the shaft 38, the large-diameter portion may be arranged in a region of the through hole 10*b* in which the increase in diameter by the centrifugal force is small. Further, for example, similarly to the second large-diameter portion 38*d*, the third large-diameter portion 38*g* may have a dimension which provides the intermediate fitting with the through hole 10*b*. In this case, degradation in ease of assembly of the compressor impeller 10 to the shaft 38 is suppressed.

As described above, even when the third large-diameter portion 38*g* is formed, the amount of eccentricity of the compressor impeller 10 is suppressed as in the above-mentioned embodiment. For example, each of the second large-diameter portion 38*d* and the third large-diameter portion 38*g* may have a length in the axial direction which is smaller than that of the second large-diameter portion 8*d* described in the above-mentioned embodiment.

Further, the shaft 38 has two small-diameter portions (first small-diameter portion $\mathbf{38}b_1$ on the oil thrower member 21 side and second small-diameter portion $\mathbf{38}b_2$ on the one end 38*a* side of the shaft 38) with the third large-diameter portion 38*g* formed therebetween. A sum of lengths of the first small-diameter portion $\mathbf{38}b_1$ and the second small-diameter portion $\mathbf{38}b_2$ in the axial direction of the shaft 38 may be approximately equal to the length of the small-diameter portion 8*b* of the above-mentioned embodiment in the axial direction of the shaft 8.

In this case, when a tension stress is applied to the shaft 8 by fastening with the nut 22, a sum of the amount of elastic deformation in the first small-diameter portion $\mathbf{38}b_1$ and the second small-diameter portion $\mathbf{38}b_2$ is approximately equal to that of the small-diameter portion 8*b*. Similarly to the small-diameter portion 8*b*, a stable axial force is generated between the nut 22 and a step surface 38*e*.

Figure 4A:
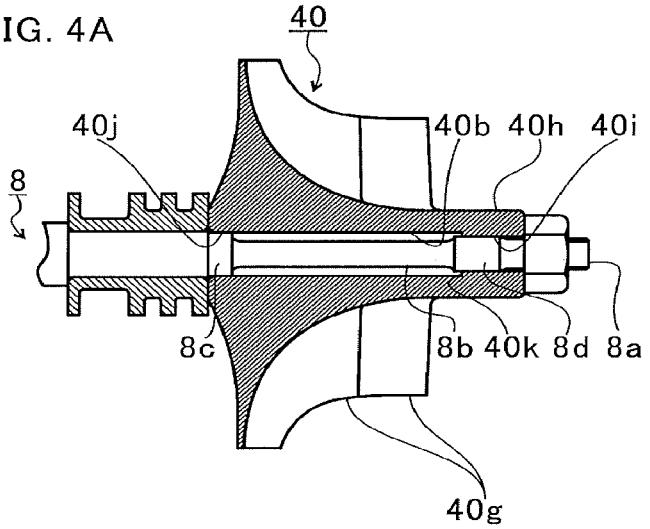
FIG. 4A is a first explanatory view for illustrating a second modification example.
Figure 4B:
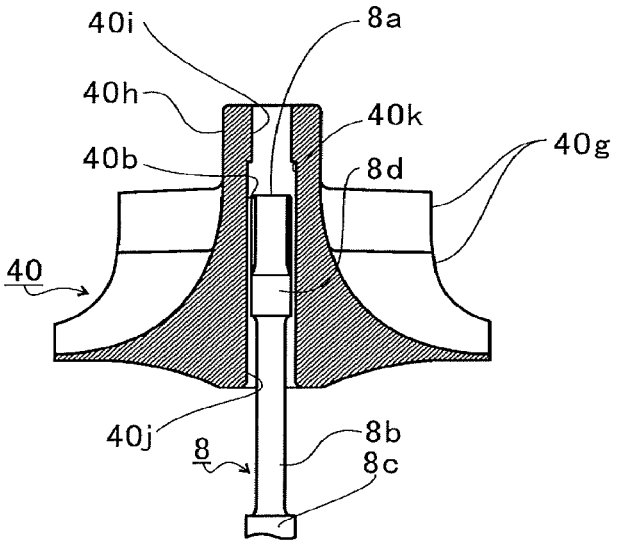
FIG. 4B is a second explanatory view for illustrating the second modification example.

FIG. 4A is a first explanatory view for illustrating a second modification example. FIG. 4B is a second explanatory view for illustrating the second modification example. As illustrated in FIG. 4A, in the second modification example, for example, a small-inner-diameter portion 40*i* is formed on a radially inner side of a boss portion 40*h* in a through hole 40*b* of a compressor impeller 40 (impeller).

An inner diameter of the small-inner-diameter portion 40*i* is smaller than an inner diameter of a part 40*j* of the through hole 40*b* which is opposed to the first large-diameter portion 8*c* in the radial direction. The small-inner-diameter portion 40*i* is a protrusion which is formed on an inner circumference surface of the through hole 40*b*. The small-inner-diameter portion 40*i* is located on the one end 8*a* side of the shaft 8 with respect to blades 40*g* of the compressor impeller 40.

Further, a step surface 40*k* is formed in an inner circumference surface of the through hole 40*b* so as to extend from the part 40*j*, which is opposed to the first large-diameter portion 8*c* of the through hole 40*b* in the radial direction, to the small-inner-diameter portion 40*i*. For example, the step surface 40*k* is located on the radially outer side of the second large-diameter portion 8*d*. The step surface 40*k* may also be located on the first large-diameter portion 8*c* side with respect to the second large-diameter portion 8*d*. The step surface 40*k* extends approximately in the radial direction of the shaft 8.

Also in the second modification example, similarly to the above-mentioned embodiment, the boss portion 40*h* is less liable to be affected by the centrifugal force of the blades 40*g*. The amount of eccentricity of the compressor impeller 40 with respect to the axial center of the shaft 8 is suppressed. The increase in unbalance of the rotary member is suppressed.

Further, as illustrated in FIG. 4B, when the compressor impeller 40 is to be assembled to the shaft 8, the shaft 8 is inserted to the through hole 40*b* from a side opposite to the small-inner-diameter portion 40*i*. That is, the second large-diameter portion 8*d* is also inserted from the side opposite to the small-inner-diameter portion 40*i*. In the second modification example, for example, an outer diameter of the second large-diameter portion 8*d* is smaller than that of the first large-diameter portion 8*c*. An outer diameter of the second large-diameter portion 8*d* is set to a dimension corresponding to an inner diameter of the small-inner-diameter portion 40*i*. That is, a clearance between the second large-diameter portion 8*d* and the part 40*j* in the radial direction is larger than a clearance between the second large-diameter portion 8*d* and the small-inner-diameter portion 40*i* in the radial direction. For example, in a case in which the compressor impeller 40 is heated, and the shaft 8 is inserted, when the through hole 40*b* and the second large-diameter portion 8*d* are brought into contact with each other, heat escapes from the compressor impeller 40 to the second large-diameter portion 8*d* side. Through formation of the part 40*j* having a large clearance in the radial direction with respect to the second large-diameter portion 8*d*, the contact between the through hole 40*b* and the second large-diameter portion 8*d* can be suppressed. Contraction of the through hole 40*b* is suppressed. That is, the resistance which is generated at the time of insertion of the shaft 8 to the through hole 40*b* is reduced. Ease of assembly is improved. Further, both the fitting between the first large-diameter portion 8*c* and the part 40*j* and the fitting between the second large-diameter portion 8*d* and the small-inner-diameter portion 40*i* may be interference fitting. Even in this case, the contact between the through hole 40*b* and the second large-diameter portion 8*d* is suppressed. The shaft 8 is easily inserted to the through hole 40*b*. Further, an inclination surface or a curved surface may be formed at a boundary between an end of the step surface 40*k* on the radially inner side and the small-inner-diameter portion 40*i*. In this case, the inclined surface or the curved surface serves as a guide so that the second large-diameter portion 8*d* is easily inserted to the small-inner-diameter portion 40*i*.

In the above, description is made of the embodiment of the present disclosure with reference to the attached drawings. However, as a matter of course, the present disclosure is not limited to the above-mentioned embodiment. It is apparent that a person skilled in the art could have easily been conceived of various examples of changes and corrections within the scope of claims, and it is to be understood that, as a matter of course, those changes and corrections fall within the technical scope of the present disclosure.

For example, in the embodiment and the modification examples mentioned above, description is made of the case in which the mounting structure 20 is provided to the turbocharger C. However, as long as the impeller is mounted to the shaft 8, 38, the mounting structure 20 may be provided also to other rotating machines. That is, the mounting structure 20 described above is applicable to any rotating machines other than the turbocharger C.

Further, in the embodiment and the modification examples mentioned above, description is made of the case in which the second large-diameter portion 8*d*, 38*d* extends longer in the axial direction of the shaft 8, 38 than the first large-diameter portion 8*c*, 38*c*. However, the second large-diameter portion 8*d*, 38*d* may have a length in the axial direction of the shaft 8, 38 which is equal to or smaller than that of the first large-diameter portion 8*c*, 38*c*. The magnitude of the friction coefficient in the surface of the shaft 8, 38 varies depending on a product. The magnitude of the friction coefficient in the surface of the shaft 8, 38 affects the resistance (friction resistance) at the time of insertion of the shaft 8, 38 to the through hole 10*b*. When the length of the second large-diameter portion 8*d*, 38*d* in the axial direction of the shaft 8, 38 is set equal to or smaller than the length of the first large-diameter portion 8*c*, 38*c* in the axial direction of the shaft 8, 38, the following effect is achieved. That is, variation in resistance which is given during insertion of the shaft 8, 38 to the through hole 10*b* at the time of assembly is suppressed to be small.

Further, in the first modification example mentioned above, description is made of the case in which the third large-diameter portion 38*g* is formed on the one end 38*a* side of the shaft 38 on the radially inner side of the plurality of blades 10*g*. However, the third large-diameter portion 38*g* may be formed at any position between the first large-diameter portion 38*c* and the second large-diameter portion 38*d*.

Further, in the embodiment and the modification examples mentioned above, description is made of the case in which the back surface portion 10*e* of the main body portion 10*a* is inclined in such an orientation that an outer diameter thereof decreases toward the another end side of the shaft 8, 38. Further, description is made of the case in which the first large-diameter portion 8*c*, 38*c* is located on the radially inner side of the back surface portion 10*e*. However, for example, the back surface portion 10*e* may extend along the radial direction of the shaft 8, 38. Further, the first large-diameter portion 8*c*, 38*c* may be displaced in the axial direction of the shaft 8, 38 from the radially inner side of the back surface portion 10*e*.

Further, in the embodiment and the modification examples mentioned above, description is made of the case in which the small-diameter portion 8*b* or the first small-diameter portion $\mathbf{38}b_1$ is located on the radially inner side of the radially outermost portion 10*f* of the main body portion 10*a*. However, the small-diameter portion 8*b* or the first small-diameter portion $\mathbf{38}b_1$ may be displaced in the axial direction of the shaft 8, 38 from the radially inner side of the radially outermost portion 10*f* of the main body portion 10*a*.

Further, in the embodiment and the modification examples mentioned above, description is made of the case in which the plurality of blades 10*g*, 40*g* include the plurality of short blades $\mathbf{10}g_1$ and the plurality of long blades $\mathbf{10}g_2$. However, the plurality of blades 10*g*, 40*g* may have one kind of length along the axial direction of the shaft 8, 38.

Further, in the second modification example mentioned above, description is made of the case in which the step surface 40*k* is formed in the inner circumference surface of the through hole 40*b*. However, there may be formed a tapered surface which gradually decreases in inner diameter from the part 40*j*, which is opposed to the first large-diameter portion 8*c* in the radial direction, toward the small-inner-diameter portion 40*i* in the through hole 40*b*. Through formation of the step surface 40*k*, the through hole 40*b* can easily be processed. The processing cost is reduced.

Further, in the second modification example mentioned above, description is made of the case in which the shaft 8 has the second large-diameter portion 8*d*. However, as long as the dimension provides mutual fitting between the small-inner-diameter portion 40*i* of the compressor impeller 40 and the small-diameter portion 8*b*, the second large-diameter portion 8*d* may be omitted. That is, the small-diameter portion 8*b* may extend to the one end 8*a* side of the shaft 8 in the axial direction to provide the relationship of mutual fitting with the small-inner-diameter portion 40*i*. Also in this case, similar to the second modification example mentioned above, for example, in the case in which the compressor impeller 40 is heated, and the shaft 8 is inserted, the contact between the through hole 40*b* and the second large-diameter portion 8*d* is suppressed. Contraction of the through hole 40*b* is suppressed. The amount of eccentricity of the compressor impeller 40 with respect to the axial center of the shaft 8 is suppressed. The increase in unbalance of the rotary member is suppressed. However, through formation of the second large-diameter portion 8*d* having an outer diameter larger than that of the small-inner-diameter portion 8*b*, the following effect is achieved. That is, it is only necessary that only the second large-diameter portion 8*d* of the shaft 8, which is to be fitted to inner circumference surface located on the radially inner side of the boss portion 40*h*, be processed with high accuracy. The processing time is shortened.

Further, the configuration of the second example, that is, for example, the configuration of providing the small-inner-diameter portion 40*i* may be applied to the embodiment and the first modification example described above.

INDUSTRIAL APPLICABILITY

The present disclosure may be used for a mounting structure for mounting an impeller to a shaft, and may be used for a turbocharger.

What is claimed is:

1. A mounting structure, comprising:

an impeller including:

a main body portion having a through hole to which a shaft is inserted;

a plurality of blades provided to an outer peripheral surface of the main body portion; and a boss portion, which is a part of the main body portion, and protrudes toward one end side of the shaft with respect to the plurality of blades;

a small-diameter portion, which is a part of the shaft, and is opposed to an inner peripheral surface of the through hole and spaced apart in the radial direction of the shaft;

a first large-diameter portion, which is a part of the shaft, is located on another end side of the shaft with respect to the small-diameter portion, and has a first outer diameter larger than an outer diameter of the small-diameter portion;

a second large-diameter portion of the shaft, which is located on one end side of the shaft with respect to the small-diameter portion, has a second outer diameter larger than the outer diameter of the small-diameter portion, and is located on a radially inner side of the boss portion;

a small-inner-diameter portion of the through hole, which is formed on a radially inner side of the boss portion, and has an inner diameter smaller than an inner diameter of a part of the through hole which is opposed to the first large-diameter portion in a radial direction; and a step surface of the through hole, which is located on a radially outer side of the second large-diameter portion, which is opposed to the second large-diameter portion in the radial direction.

2. The mounting structure according to claim 1, wherein the second large-diameter portion extends longer in the axial direction of the shaft than the first large-diameter portion.

3. The mounting structure according to claim 1, wherein the through hole and the first large-diameter portion are fitted to each other by interference fitting, and the through hole and the second large-diameter portion are fitted to each other by intermediate fitting.

4. The mounting structure according to claim 2, wherein the through hole and the first large-diameter portion are fitted to each other by interference fitting, and the through hole and the second large-diameter portion are fitted to each other by intermediate fitting.

5. The mounting structure according to claim 1, further comprising a third large-diameter portion of the shaft, which is located between the first large-diameter portion and the second large-diameter portion, and has a third outer diameter larger than the outer diameter of the small-diameter portion.

6. The mounting structure according to claim 2, further comprising a third large-diameter portion of the shaft, which is located between the first large-diameter portion and the second large-diameter portion, and has a third outer diameter larger than the outer diameter of the small-diameter portion.

7. The mounting structure according to claim 3, further comprising a third large-diameter portion of the shaft, which is located between the first large-diameter portion and the second large-diameter portion, and has a third outer diameter larger than the outer diameter of the small-diameter portion.

8. The mounting structure according to claim 4, further comprising a third large-diameter portion of the shaft, which is located between the first large-diameter portion and the second large-diameter portion, and has a third outer diameter larger than the outer diameter of the small-diameter portion.

9. The mounting structure according to claim 1, wherein a back surface portion of the main body portion, which is located on another end side of the shaft with respect to the plurality of blades, is inclined in such an orientation that an outer diameter of the back surface portion of the main body portion decreases toward the another end side of the shaft, and wherein the first large-diameter portion is located on a radially inner side of the back surface portion.

10. The mounting structure according to claim 2, wherein a back surface portion of the main body portion, which is located on another end side of the shaft with respect to the plurality of blades, is inclined in such an orientation that an outer diameter of the back surface portion of the main body portion decreases toward the another end side of the shaft, and wherein the first large-diameter portion is located on a radially inner side of the back surface portion.

11. The mounting structure according to claim 3, wherein a back surface portion of the main body portion, which is located on another end side of the shaft with respect to the plurality of blades, is inclined in such an orientation that an outer diameter of the back surface portion of the main body portion decreases toward the another end side of the shaft, and wherein the first large-diameter portion is located on a radially inner side of the back surface portion.

12. The mounting structure according to claim 4, wherein a back surface portion of the main body portion, which is located on another end side of the shaft with respect to the plurality of blades, is inclined in such an orientation that an outer diameter of the back surface portion of the main body portion decreases toward the another end side of the shaft, and wherein the first large-diameter portion is located on a radially inner side of the back surface portion.

13. The mounting structure according to claim 1, wherein the small-diameter portion is located on a radially inner side of a radially outermost portion of the main body portion which extends to an outermost side in the radial direction of the shaft.

14. The mounting structure according to claim 2, wherein the small-diameter portion is located on a radially inner side of a radially outermost portion of the main body portion which extends to an outermost side in the radial direction of the shaft.

15. The mounting structure according to claim 3, wherein the small-diameter portion is located on a radially inner side of a radially outermost portion of the main body portion which extends to an outermost side in the radial direction of the shaft.

16. The mounting structure according to claim 4, wherein the small-diameter portion is located on a radially inner side of a radially outermost portion of the main body portion which extends to an outermost side in the radial direction of the shaft.

17. A turbocharger, comprising the mounting structure according to claim 1.

* * * * *